US012808379B2

(12) United States Patent
Tokumi et al.

(10) Patent No.: US 12,808,379 B2
(45) Date of Patent: Nov. 24, 2026

(54) HERMETIC COMPRESSOR AND REFRIGERATION CYCLE APPARATUS

(71) Applicant: Mitsubishi Electric Corporation, Tokyo (JP)

(72) Inventors: Shinnosuke Tokumi, Tokyo (JP); Ryo Hamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 19/134,592

(22) PCT Filed: Mar. 14, 2023

(86) PCT No.: PCT/JP2023/009873

§ 371 (c)(1),
(2) Date: May 30, 2025

(87) PCT Pub. No.: WO2024/189776

PCT Pub. Date: Sep. 19, 2024

(65) Prior Publication Data

US 2026/0201886 A1 Jul. 16, 2026

(51) Int. Cl.
*F04C 29/12* (2006.01)
*F04C 18/356* (2006.01)

(52) U.S. Cl.
CPC ..... *F04C 29/126* (2013.01); *F04C 18/356* (2013.01)

(58) Field of Classification Search
CPC ..... F04C 18/356–3564; F04C 29/122–128; F04C 18/344–3445
See application file for complete search history.

(56) References Cited

U.S. PATENT DOCUMENTS

2022/0178372 A1* 6/2022 Inada ..... F04C 29/042

FOREIGN PATENT DOCUMENTS

CN 202117924 U * 1/2012
CN 104791251 A * 7/2015
CN 104806522 A 7/2015
CN 105065272 A * 11/2015
(Continued)

OTHER PUBLICATIONS

International Search Report dated May 16, 2023 issued in the corresponding International Application No. PCT/JP2023/009873 (and English translation).

*Primary Examiner* — Alexander B Comley
(74) *Attorney, Agent, or Firm* — Posz Law Group, PLC

(57) ABSTRACT

A hermetic compressor is provided with a cylinder in which a compression chamber and an injection vertical hole through which refrigerant is supplied into the compression chamber are formed, closure components that close the compression chamber, and an injection check valve. The injection vertical hole has one end formed at one end surface of the cylinder, in which first fixation holes are formed through which first fixation components that fix a corresponding one of the closure components to the one end surface are inserted. The first fixation holes are located such that distances from centers of the first fixation holes to a center of the cylinder are the same. The injection vertical hole has at least a portion located in a region inside an imaginary circle centered at the center of the cylinder and has radii from the center of the cylinder to the centers of the first fixation holes.

16 Claims, 9 Drawing Sheets

(56) References Cited

FOREIGN PATENT DOCUMENTS

| | | | | | |
|---|---|---|---|---|---|
| CN | 204941943 | U | * | 1/2016 | |
| CN | 103423163 | B | * | 12/2017 | |
| CN | 104806522 | B | * | 5/2018 | ..... F04C 18/3564 |
| EP | 3783225 | A1 | * | 2/2021 | ..... F04C 29/128 |
| JP | H05-026167 | A | | 2/1993 | |
| JP | 05026167 | A | * | 1/2012 | |
| JP | 2012-107568 | A | | 6/2012 | |
| JP | 2013036442 | A | * | 2/2013 | |
| JP | 2019-167839 | A | | 10/2019 | |
| WO | WO-2016179813 | A1 | * | 11/2016 | ..... F04C 29/00 |
| WO | WO-2019171508 | A1 | * | 9/2019 | ..... F04C 29/04 |

* cited by examiner

HERMETIC COMPRESSOR AND REFRIGERATION CYCLE APPARATUS

CROSS REFERENCE TO RELATED APPLICATION

This application is a U.S. national stage application of PCT/JP2023/009873 filed on Mar. 14, 2023, the contents of which are incorporated herein by reference.

TECHNICAL FIELD

The present disclosure relates to a hermetic compressor and a refrigeration cycle apparatus that have an injection mechanism.

BACKGROUND ART

Some hermetic compressor is equipped with a motor that includes a rotor and a stator and is located at an upper portion of a hermetic container. The rotation of the motor is transmitted to a machine section located below the motor by a crankshaft fixed to the rotor. The machine section mainly consists of a cylinder, a main shaft bearing, a sub-shaft bearing, an intermediate plate, and a piston. When the crankshaft, which is eccentrically shaped, rotates, the piston is eccentrically rotated. This eccentric rotation reduces the volume of a compression chamber and thereby compresses refrigerant.

Also, an injection hole that communicates with the compression chamber is formed in one or more of the main shaft bearing, the sub-shaft bearing, and the intermediate plate. Intermediate-pressure liquid or gas refrigerant is thereby injected into the compression chamber through an injection pipe, which is press-fitted or welded. By adding this injection refrigerant, the flow rate of refrigerant discharged from the rotary compressor accordingly increases and the performance of its refrigeration cycle thereby increases. Also, the injection refrigerant cools a compression mechanism section and thereby helps prevent a failure of the compressor and improve reliability. To reduce deterioration in compressor efficiency caused by backflow of compressed refrigerant into this injection passage, a configuration includes a check valve in the middle of the injection passage (see, for example, Patent Literature 1).

CITATION LIST

Patent Literature

Patent Literature 1: Japanese Unexamined Patent Application Publication No. 2019-190302

SUMMARY OF INVENTION

Technical Problem

In a hermetic compressor that has an injection mechanism as in Patent Literature 1, refrigerant (the intermediate-pressure refrigerant described above) higher in pressure than suction refrigerant is injected into a compression chamber at a high rate as injection refrigerant. A problem lies in that the hydrodynamic force of the injection refrigerant may locally separate the seal between a cylinder and a main shaft bearing, a sub-shaft bearing, or an intermediate plate. As a result, refrigerant is likely to leak out of a compression mechanism section and compression efficiency may thereby deteriorate.

The present disclosure is made to solve such problems as described above and an object of the present disclosure is to provide a hermetic compressor and a refrigeration cycle apparatus that prevent leakage of injection refrigerant and also prevent deterioration in compression efficiency.

Solution to Problem

A hermetic compressor according to an embodiment of the present disclosure is provided with a cylinder in which a compression chamber in which refrigerant is compressed and an injection vertical hole that forms a portion of an injection passage through which refrigerant is supplied into the compression chamber and extends in a height direction are formed, closure components that are fixed to both respective end surfaces of the cylinder in a height direction and close the compression chamber, and an injection check valve that opens and closes the injection vertical hole. The injection vertical hole has one end formed at one end surface of the cylinder. In the one end surface of the cylinder, a plurality of first fixation holes are formed through which a plurality of first fixation components that fix a corresponding one of the closure components to the one end surface are inserted. The plurality of first fixation holes are located such that distances from centers of the plurality of first fixation holes to a center of the cylinder are the same. The injection vertical hole has at least a portion located in a region inside an imaginary circle that has a circle center defined by the center of the cylinder and has radii from the center of the cylinder to the centers of the plurality of first fixation holes.

Also, a hermetic compressor according to an embodiment of the present disclosure is provided with a cylinder in which a compression chamber in which refrigerant is compressed and an injection vertical hole that forms a portion of an injection passage through which refrigerant is supplied into the compression chamber and extends in a height direction are formed, closure components that are fixed to both respective end surfaces of the cylinder in a height direction and close the compression chamber, and an injection check valve that opens and closes the injection vertical hole. The injection vertical hole has one end formed at one end surface of the cylinder. In the one end surface of the cylinder, a plurality of first fixation holes are formed through which a plurality of first fixation components that fix a corresponding one of the closure components to the one end surface are inserted. In a case where, among the plurality of first fixation holes, one that has a shortest distance from a center of the one of the plurality of first fixation holes to a center of the cylinder is defined as a shortest first fixation hole, the injection vertical hole has at least a portion located in a region inside an imaginary circle that has a circle center defined by the center of the cylinder and has a radius from the center of the cylinder to a center of the shortest first fixation hole.

Also, a refrigeration cycle apparatus according to an embodiment of the present disclosure is provided with a hermetic compressor described above.

Advantageous Effects of Invention

A hermetic compressor and a refrigeration cycle apparatus according to an embodiment of the present disclosure are provided with a cylinder in which an injection vertical hole that forms a portion of an injection passage is formed. The injection vertical hole has at least a portion located in a region inside an imaginary circle that has the circle center defined by the center of the cylinder and has radii from the center of the cylinder to the centers of a plurality of first fixation holes. Alternatively, the injection vertical hole has at least a portion located in a region inside an imaginary circle that has the circle center defined by the center of the cylinder and has a radius from the center of the cylinder to the center of the shortest first fixation hole. By thus locating the injection vertical hole, leakage of injection refrigerant is prevented and deterioration in compression efficiency is also prevented.

DESCRIPTION OF EMBODIMENTS

Figure 1:
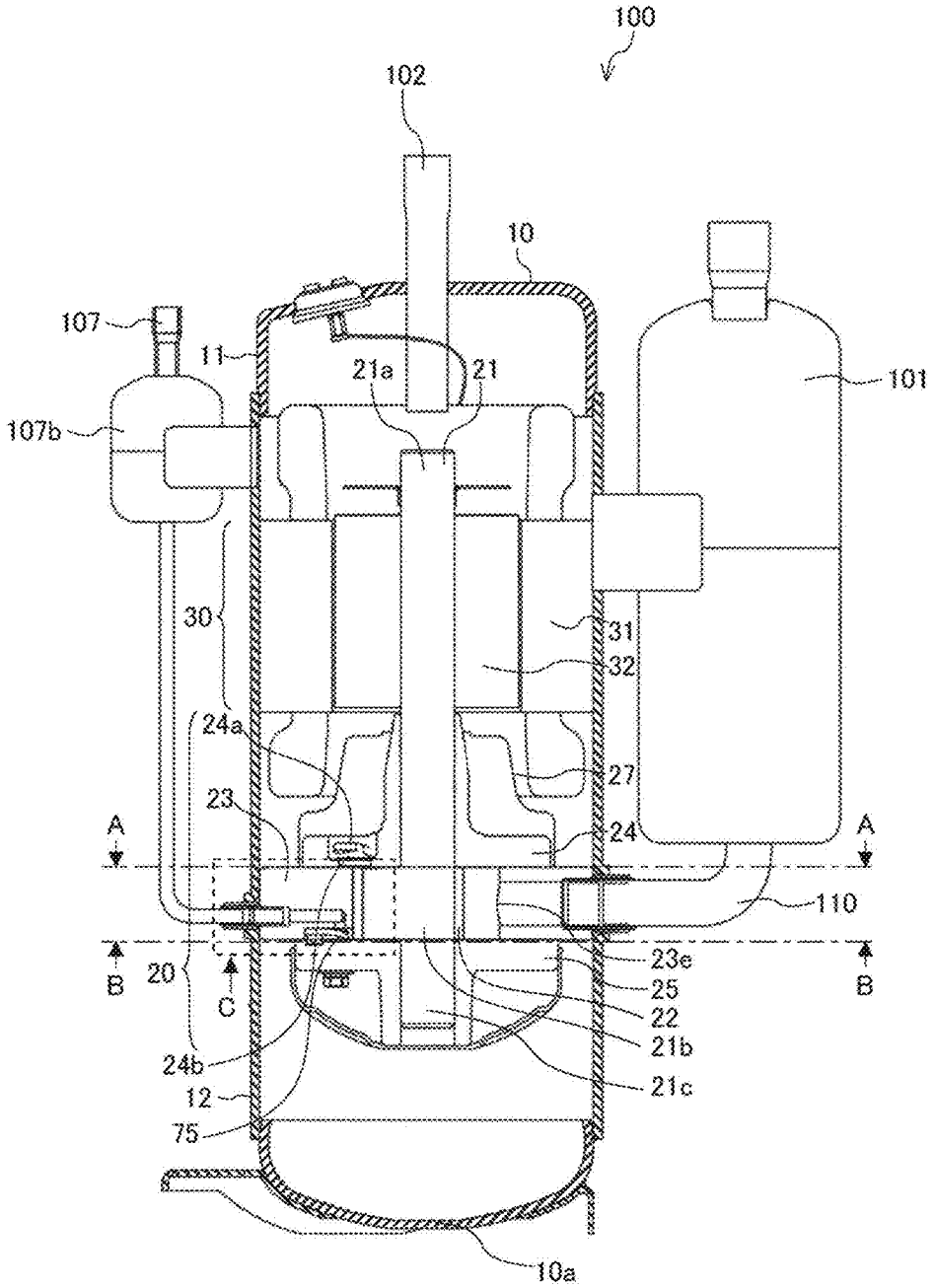
FIG. 1 is a schematic diagram that illustrates a vertical section of a hermetic compressor according to an embodiment.

An embodiment of the present disclosure is described below with reference to drawings. Note that the present disclosure is not limited to the embodiment described below. Also, a relationship in size between components in the drawings illustrated below may differ from the actual one.

EMBODIMENT

Figure 2:
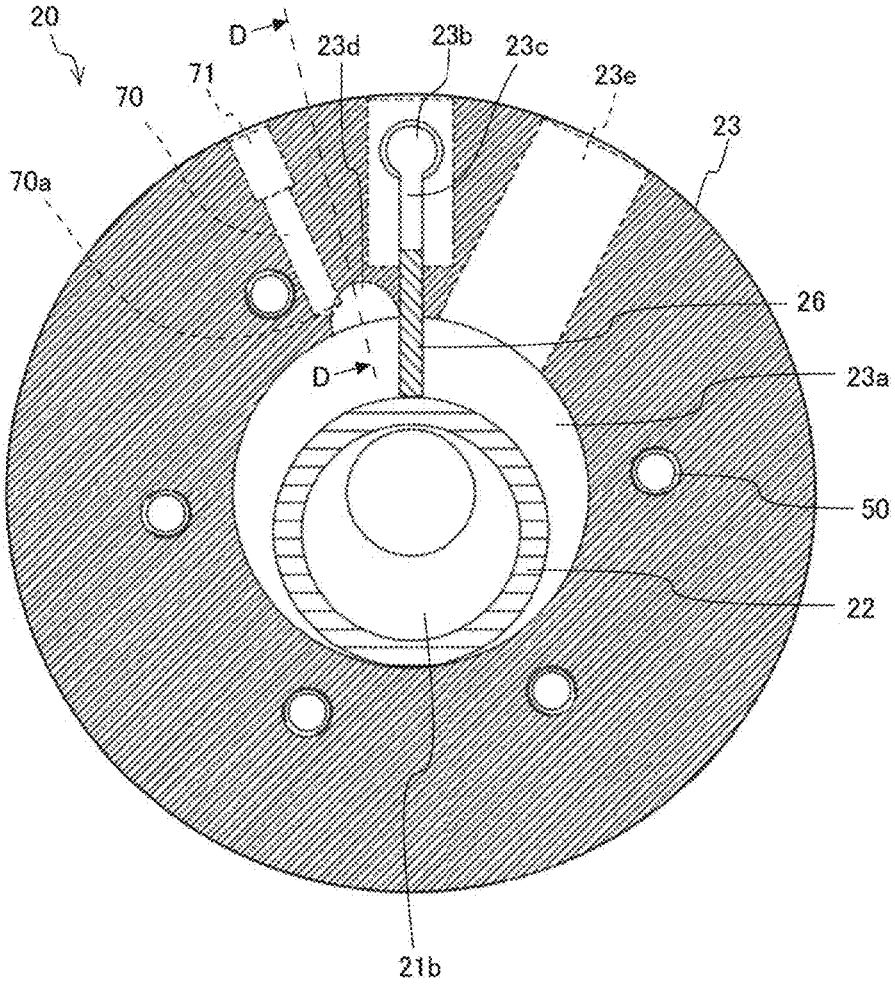
FIG. 2 is a schematic plan view that illustrates a compression mechanism section when the hermetic compressor illustrated in FIG. 1 is sectioned along A-A line and viewed in the direction of arrows.
Figure 3:
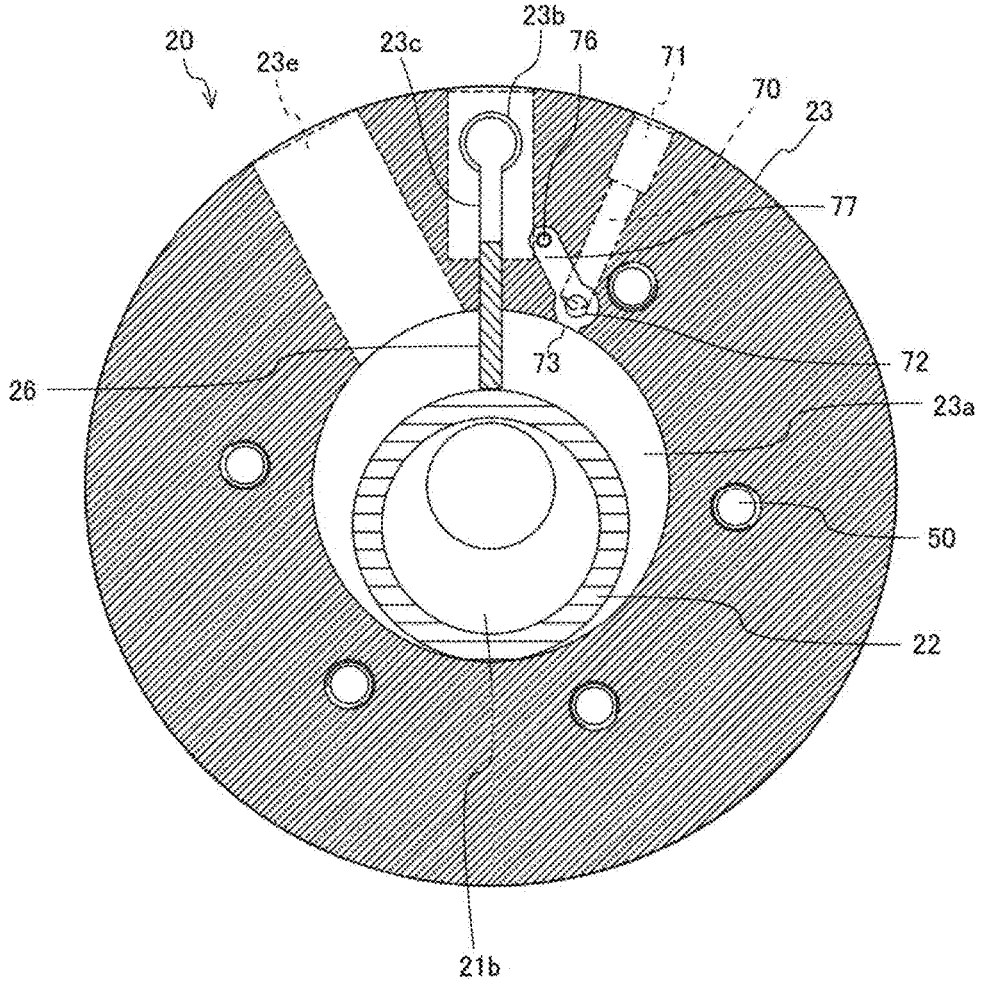
FIG. 3 is a schematic plan view that illustrates the compression mechanism section when the hermetic compressor illustrated in FIG. 1 is sectioned along B-B line and viewed in the direction of arrows.
Figure 4:
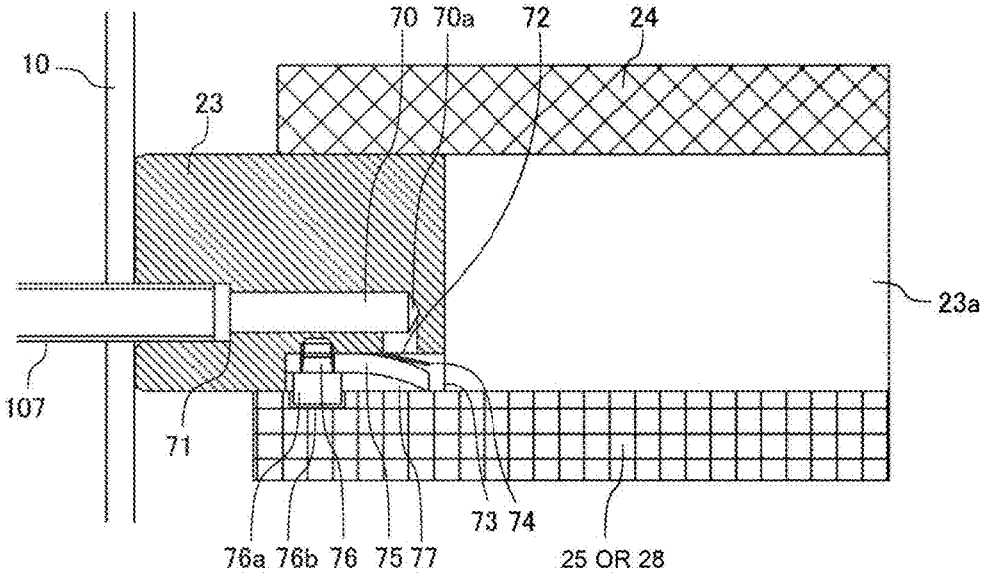
FIG. 4 is an enlarged schematic diagram that illustrates a portion of the hermetic compressor illustrated in FIG. 1 indicated by arrow C.
Figure 5:
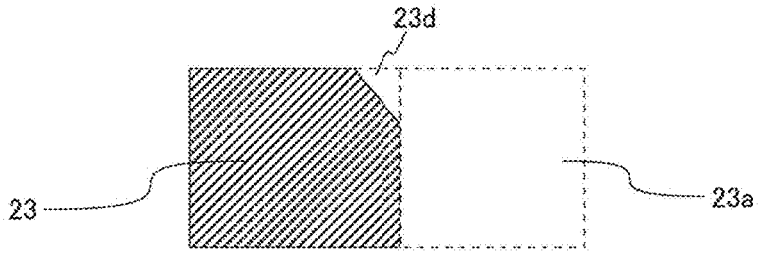
FIG. 5 is a vertical sectional schematic diagram that illustrates a cylinder when the compression mechanism section illustrated in FIG. 2 is sectioned along D-D line and viewed in the direction of arrows.
Figure 6:
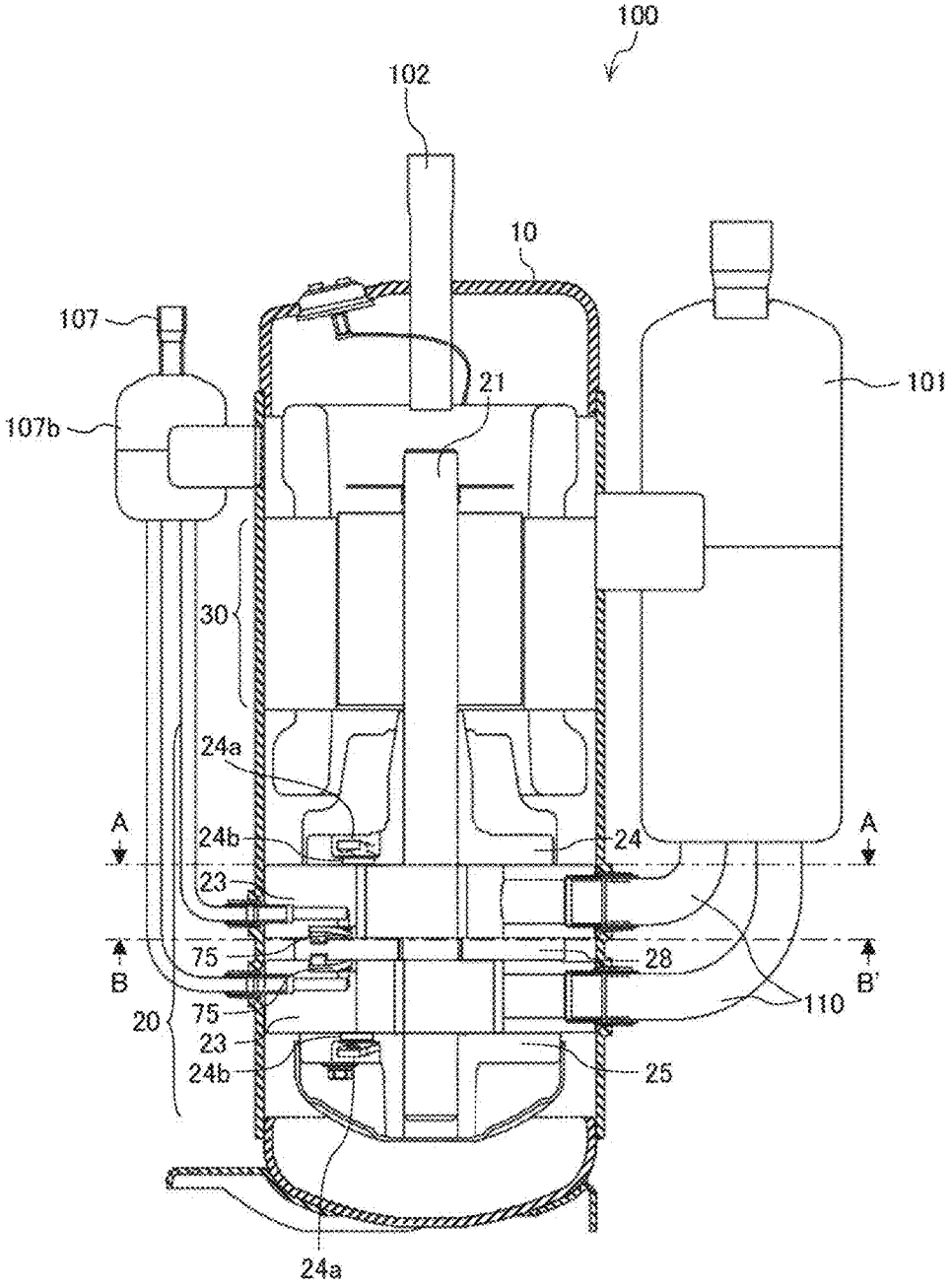
FIG. 6 is a schematic diagram that illustrates a vertical section of a modification of the hermetic compressor according to the embodiment.

FIG. 1 is a schematic diagram that illustrates a vertical section of a hermetic compressor 100 according to an embodiment. FIG. 2 is a schematic plan view that illustrates a compression mechanism section 20 when the hermetic compressor 100 illustrated in FIG. 1 is sectioned along A-A line and viewed in the direction of arrows. FIG. 3 is a schematic plan view that illustrates the compression mechanism section 20 when the hermetic compressor 100 illustrated in FIG. 1 is sectioned along B-B line and viewed in the direction of arrows. FIG. 4 is an enlarged schematic diagram that illustrates a portion of the hermetic compressor 100 illustrated in FIG. 1 indicated by arrow C. FIG. 5 is a vertical sectional schematic diagram that illustrates a cylinder 23 when the compression mechanism section 20 illustrated in FIG. 2 is sectioned along D-D line and viewed in the direction of arrows. FIG. 6 is a schematic diagram that illustrates a vertical section of a modification of the hermetic compressor 100 according to the embodiment.

For the hermetic compressor 100 according to Embodiment 1, a one-cylinder rotary compressor that has one cylinder 23 as illustrated in FIG. 1, namely, a single rotary compressor is used. The entire configuration of the hermetic compressor 100, which is a single rotary compressor, is described below.

As illustrated in FIG. 1, the hermetic compressor 100 is provided with the compression mechanism section 20, which compresses refrigerant gas, and a motor 30, which drives the compression mechanism section 20, both of which are housed in a hermetic container 10. The hermetic container 10 consists of an upper container 11 and a lower container 12. The compression mechanism section 20 is housed in a lower portion of the hermetic container 10 and the motor 30 is housed in an upper portion of the hermetic container 10. The motor 30 consists of a stator 31 and a rotor 32. The compression mechanism section 20 and the motor 30 are connected by a rotating shaft 21, which extends in the vertical direction. The rotating shaft 21 transmits the rotational movement of the motor 30 to the compression mechanism section 20. By the transmitted rotational force, refrigerant gas in the compression mechanism section 20 is compressed and discharged within the hermetic container 10. The hermetic container 10 is filled with compressed high-temperature and high-pressure refrigerant gas while refrigerating machine oil is stored in a bottom portion 10*a* of the hermetic container 10 to lubricate the compression mechanism section 20. At a lower portion of the rotating shaft 21, an unillustrated oil pump is provided. Along with the rotation of the rotating shaft 21, the oil pump draws up refrigerating machine oil stored in the bottom portion 10*a* of the hermetic container 10 and the refrigerating machine oil is supplied to sliding portions of the compression mechanism section 20. Therefore, the mechanical lubricating action of the compression mechanism section 20 is ensured.

The rotating shaft 21 consists of a main shaft portion 21*a*, an eccentric shaft portion 21*b*, and an auxiliary shaft portion 21*c* such that the main shaft portion 21*a*, the eccentric shaft portion 21*b*, and the auxiliary shaft portion 21*c* are formed in this order from top to bottom in the axial direction. The motor 30 is fixed to the main shaft portion 21*a* by being shrink-fitted or press-fitted and a rolling piston 22, which is cylindrically shaped, is slidably fitted to the eccentric shaft portion 21*b*.

As illustrated in FIG. 1 to FIG. 3, the compression mechanism section 20 is provided with the rolling piston 22, the cylinder 23, an upper bearing 24, a lower bearing 25, and a vane 26. In the cylinder 23, a compression chamber 23*a*, which is a circular cylindrical space that has both open ends in the axial direction, is formed. In the compression chamber 23*a*, the following components are housed: the eccentric shaft portion 21*b* of the rotating shaft 21, which makes eccentric movement in the compression chamber 23*a*, the rolling piston 22 fitted to the eccentric shaft portion 21*b*, and the vane 26, which partitions a space formed by the inner surface of the cylinder 23 and the outer surface of the rolling piston 22 into a suction side in which refrigerant is drawn and a compression side in which refrigerant is compressed.

In the cylinder 23, a vane groove 23*c* is formed, which extends in a radial direction and passes through the cylinder 23 in the axial direction. The vane groove 23*c* has one end in the radial direction that is open to the inside of the compression chamber 23*a* and the other end in the radial direction where a back-pressure chamber 23*b* is formed. In the vane groove 23*c*, the vane 26 is housed. The vane 26 makes reciprocating movement in a radial direction in the vane groove 23*c*. The shape of the vane 26 in a state where it is attached to the vane groove 23*c* is a substantially cuboidal shape that has the thickness in the circumferential direction of the compression chamber 23*a*, which is smaller than each of the length in a radial direction of the compression chamber 23*a* and the length in the axial direction of the compression chamber 23*a*. To the back-pressure chamber 23*b* of the vane groove 23*c*, an unillustrated vane spring is provided.

Typically, high-pressure refrigerant gas in the hermetic container 10 flows into the back-pressure chamber 23*b* and the differential pressure between the pressure of refrigerant gas in the back-pressure chamber 23*b* and the pressure of refrigerant gas in the compression chamber 23*a* generates a force that moves the vane 26 toward the center of the compression chamber 23*a* in a radial direction. By the force thus generated from the differential pressure between the pressure of refrigerant gas in the back-pressure chamber 23*b* and the pressure of refrigerant gas in the compression chamber 23*a* and by a force generated by the vane spring, which presses the vane 26 in a radial direction, the vane 26 is moved toward the center of the compression chamber 23*a* in the radial direction. The force that moves the vane 26 in a radial direction brings one end of the vane 26, namely, the end portion on the compression chamber 23*a* side, into contact with the outer surface of the rolling piston 22, which is cylindrically shaped. As a result, the space formed by the inner surface of the cylinder 23 and the outer surface of the rolling piston 22 is partitioned. Even in a case where the differential pressure between the pressure of refrigerant gas in the hermetic container 10, namely, refrigerant gas in the back-pressure chamber 23*b* and the pressure of refrigerant gas in the compression chamber 23*a* is not a sufficient pressure to press the vane 26 against the outer surface of the rolling piston 22, both the differential pressure and the force of the vane spring press the one end of the vane 26 against the outer surface of the rolling piston 22. For this reason, the one end of the vane 26 is always in contact with the outer surface of the rolling piston 22.

As illustrated in FIG. 1, the upper bearing 24 has a substantial inverted T-shape in a side view and is fitted to the main shaft portion 21*a* of the rotating shaft 21, and thereby rotatably supports the main shaft portion 21*a* and also closes one of the opening portions of the compression chamber 23*a* in the axial direction. Similarly, the lower bearing 25 has a substantial T-shape in a side view and is fitted to the auxiliary shaft portion 21*c* of the rotating shaft 21, and thereby rotatably supports the auxiliary shaft portion 21*c* and also closes the other opening portion of the compression chamber 23*a* in the axial direction. Also, in the upper bearing 24, a discharge port 24*b* is provided, through which refrigerant gas compressed in the compression chamber 23*a* is discharged out of the compression chamber 23*a*. As illustrated in FIG. 2, in the cylinder 23, a suction port 23*e* is provided, through which low-pressure refrigerant gas is drawn from outside the hermetic container 10 into the compression chamber 23*a*. Also, as illustrated in FIG. 2 and FIG. 5, in the cylinder 23, a discharge notch 23*d* is formed to prevent the flow passage of refrigerant that communicates with the discharge port 24*b* from suddenly contracting and bending. This discharge notch 23*d* is formed by cutting out a portion of the inner surface side of the upper end surface of the cylinder 23.

As illustrated in FIG. 1, in the upper bearing 24, a discharge valve 24*a* is provided, which is long-shaped and closes and opens the discharge port 24*b*. At one end of the discharge valve 24*a*, a fixed portion is provided that is fixed by an unillustrated fixation component. At the other end of the discharge valve 24*a*, a circular-shaped head portion is provided that closes and opens the discharge port 24*b*. The discharge valve 24*a* is an opening-and-closing valve that lifts in the upper bearing 24 and acts as a leaf spring and its head portion closes and opens the discharge port 24*b*. The discharge timing is thereby controlled at which high-temperature and high-pressure refrigerant gas is discharged from the inside of the compression chamber 23*a* through the discharge port 24*b* to the outside of the compression chamber 23*a*. That is, the discharge valve 24*a* closes the discharge port 24*b* with its head portion until refrigerant gas compressed in the compression chamber 23*a* of the cylinder 23 reaches a specified pressure and then opens the discharge port 24*b* when the pressure reaches or exceeds the specified pressure and thereby discharges high-temperature and high-pressure refrigerant gas to the outside of the compression chamber 23*a*. Note that the upper bearing 24 is also referred to as a closure component.

Here, for the hermetic compressor 100 according to the embodiment, instead of the single rotary compressor described above, a rotary compressor that has a plurality of cylinders 23 may also be used. In a case of a twin rotary compressor that has two cylinders 23 as illustrated in FIG. 6, the compression mechanism section 20 is provided with an intermediate plate 28, in addition to the rolling pistons 22, the cylinders 23, the upper bearing 24, the lower bearing 25, and the vanes 26, which are described above. Similarly to the upper bearing 24, the lower bearing 25 is also provided with the discharge port 24*b* and the discharge valve 24*a*. In this case, the upper bearing 24 and the lower bearing 25 are also referred to as closure components. Also, to the two cylinders 23, respective suction ports 23*e* are provided. That is, to one cylinder 23, one suction port 23*e* and one discharge port 24*b* are provided.

As illustrated in FIG. 2 to FIG. 4, in the cylinder 23, an injection lateral hole 70 is formed, which extends in a radial direction. At the outside of this radial direction, an injection pipe connection portion 71 is formed, which communicates with the injection lateral hole 70. An injection pipe 107 is also connected to the injection pipe connection portion 71. Also, in the cylinder 23, an injection vertical hole 72 is formed, which extends in the height direction (also referred to as the axial direction). The injection vertical hole 72 is formed close to the inner end of the injection lateral hole 70 in a radial direction. Hereinafter, the injection lateral hole 70 and the injection vertical hole 72 are collectively referred to as the injection hole. This injection hole forms a portion of an injection passage through which injection refrigerant flows from the injection pipe 107 into the compression chamber 23*a*. Here, the end portion of the injection lateral hole 70 that is on the compression chamber 23*a* side is positioned outward of the inner surface of the cylinder 23 and is separate from the compression chamber 23*a*. For this reason, the injection lateral hole 70 does not communicate with the compression chamber 23*a*. A tip hole 70*a* that has a conical shape is also formed at the inner end of the injection lateral hole 70 in a radial direction. Also, at one end surface of the cylinder 23 in the height direction and at the inner surface side of the cylinder 23, an injection check valve operation groove 77 is formed. This injection check valve operation groove 77 is opened such that the inner surface side of the cylinder 23 faces toward the center of the cylinder 23. Furthermore, one end of the injection vertical hole 72 in the axial direction communicates with the injection lateral hole 70 and the other end communicates with the injection check valve operation groove 77. In other words, the injection vertical hole 72 reaches one end surface of the cylinder 23 in the height direction. Here, the injection vertical hole 72 may also be in communication with the tip hole 70*a*. If the injection vertical hole 72 and the tip hole 70*a* are not in communication with each other, the injection vertical hole 72 would have to be located on the outer surface side of the cylinder 23 and the location of an injection check valve 74 would be subject to restrictions. However, by causing the injection vertical hole 72 and the tip hole 70*a* to be in communication with each other, the injection vertical hole 72 is located on the center side of the cylinder 23 and the location of the injection check valve 74 is subject to fewer restrictions.

To the injection check valve operation groove 77, the injection check valve 74, which is long-shaped, and an injection check valve lift amount control plate 75, which is also long-shaped, are provided. At one end of the injection check valve 74, a fixed portion is provided that is fixed by a fixation component 76, which is described later. At the other end of the injection check valve 74, a circular-shaped head portion is provided that closes and opens the injection vertical hole 72. The injection check valve 74 is an opening-and-closing valve that lifts in the injection check valve operation groove 77 and acts as a leaf spring and its head portion closes and opens the injection vertical hole 72. The injection timing is thereby controlled at which injection refrigerant that flows from the injection pipe 107 through the injection hole is injected into the compression chamber 23*a*. Also, the injection check valve lift amount control plate 75 is provided opposite to the injection vertical hole 72 across the injection check valve 74 and limits the lift amount of the injection check valve 74.

The injection check valve 74 and the injection check valve lift amount control plate 75 are fixed to one end surface of the cylinder 23 in the height direction by the fixation component 76. The fixation component 76 is, for example, a bolt. As illustrated in FIG. 4, its head portion 76*a* projects outward of the end surface of the cylinder 23 in the height direction. In a case of a single rotary compressor, a storage hole 76*b* in which the head portion 76*a*, which projects, is housed is provided in the lower bearing 25. In a case of a twin rotary compressor, the storage hole 76*b* is provided in the intermediate plate 28. The depth of the injection check valve operation groove 77, that is, the length of the axial direction, is thereby limited and, as a result, compressed refrigerant is efficiently discharged. Note that the fixation component 76 may also be a component other than a bolt, such as a rivet.

The injection vertical hole 72 is opened and closed by the injection check valve 74, which is a leaf spring. Also, the injection check valve 74 is prevented from excessively lifting by the injection check valve lift amount control plate 75. Also, on the inner side of the injection check valve operation groove 77 in a radial direction, a communication portion 73, which causes the injection vertical hole 72 and the compression chamber 23*a* to communicate with each other, is formed. For this reason, the injection check valve operation groove 77 communicates with the compression chamber 23*a* through the communication portion 73.

When the pressure in the compression chamber 23*a* is lower than the injection pressure of injection refrigerant, the injection refrigerant pushes up the injection check valve 74 and flows into the compression chamber 23*a*. Accordingly, the flow rate of refrigerant compressed in and discharged from the cylinder 23 increases by the amount of the injection refrigerant. Also, when compression proceeds in the compression chamber 23*a* and a high-pressure state is reached, the injection check valve 74 seats on an end surface of the cylinder 23 in the height direction and thereby closes the injection vertical hole 72 and prevents backflow of high-pressure refrigerant from the compression chamber 23*a* into the injection vertical hole 72.

Note that also in a case where a plurality of cylinders 23 are provided instead of the single cylinder 23, one injection mechanism is provided for each cylinder 23. Specifically, the compression chambers 23*a* are provided in the same number as the cylinders 23 and the respective injection mechanisms, which each inject intermediate-pressure refrigerant, are provided for the compression chambers 23*a*. Here, the components of the injection mechanism according to the embodiment are the suction port 23*e*, the discharge valve 24*a*, the discharge port 24*b*, the injection lateral hole 70, the tip hole 70*a*, the injection pipe connection portion 71, the injection vertical hole 72, the communication portion 73, the injection check valve 74, the injection check valve lift amount control plate 75, the fixation component 76, and the injection check valve operation groove 77.

At the compression chamber 23*a*, the actions of suction, compression, and discharge are repeated. Refrigerant gas discharged from the discharge port 24*b* is intermittently discharged and thereby generates noise such as pulsation sound. To reduce the noise, as illustrated in FIG. 1, a discharge muffler 27 is attached on the outside of the upper bearing 24, that is, on the motor 30 side such that the discharge muffler 27 covers the upper bearing 24. In the discharge muffler 27, a space formed by the discharge muffler 27 and the upper bearing 24 and an unillustrated discharge hole that communicates with the inside of the hermetic container 10 are formed. Refrigerant gas discharged from the cylinder 23 through the discharge port 24*b* is once discharged into the space formed by the discharge muffler 27 and the upper bearing 24 and is subsequently discharged within the hermetic container 10 from the discharge hole.

As illustrated in FIG. 1, beside the hermetic container 10, a suction muffler 101 is provided, which prevents liquid refrigerant from being directly drawn into the compression chamber 23*a* of the cylinder 23. Typically, the hermetic compressor 100 receives a mixture of low-pressure refrigerant gas and liquid refrigerant sent from an external circuit to which the hermetic compressor 100 is connected. Liquid refrigerant that flows into the cylinder 23 and is compressed by the compression mechanism section 20 causes a failure of the compression mechanism section 20. To prevent such a problem, the suction muffler 101 separates liquid refrigerant and refrigerant gas and sends only the refrigerant gas into the compression chamber 23*a*. The suction muffler 101 is connected to the suction port 23*e* of the cylinder 23 by a suction connection pipe 110. Low-pressure refrigerant gas sent from the suction muffler 101 is drawn into the compression chamber 23*a* through the suction connection pipe 110.

The compression mechanism section 20 is structured as described above and the eccentric shaft portion 21*b* of the rotating shaft 21 rotates in the compression chamber 23*a* of the cylinder 23 by the rotational movement of the rotating shaft 21. Working chambers defined by the inner surface of the compression chamber 23*a*, the outer surface of the rolling piston 22 fitted to the eccentric shaft portion 21*b*, and the vane 26 increase and decrease in volume along with the rotation of the rotating shaft 21. First, initially, one of these working chambers and the suction port 23*e* communicate with each other and low-pressure refrigerant gas is drawn into the working chamber. Next, the communication between the working chamber and the suction port 23*e* is closed. Along with the reduction in the volume of the working chamber, refrigerant gas in the working chamber is compressed. Lastly, the working chamber and the discharge port 24*b* communicate with each other and, after the refrigerant gas in the working chamber reaches a specified pressure, the discharge valve 24*a* provided to the discharge port 24*b* opens. The refrigerant gas is thereby released to the outside of the working chamber, that is, the outside of the compression chamber 23*a*. As a result, the refrigerant gas that has become high in temperature and high in pressure is discharged. High-temperature and high-pressure refrigerant gas discharged within the hermetic container 10 from the inside of the compression chamber 23*a* through the discharge muffler 27 passes through the inside of the motor 30, rises inside the hermetic container 10, and is discharged to the outside of the hermetic container 10 from a discharge pipe 102 provided to an upper portion of the hermetic container 10. Outside the hermetic container 10, a refrigerant circuit is structured through which refrigerant flows. The discharged refrigerant circulates in the refrigerant circuit and returns to the suction muffler 101 again.

Figure 7:
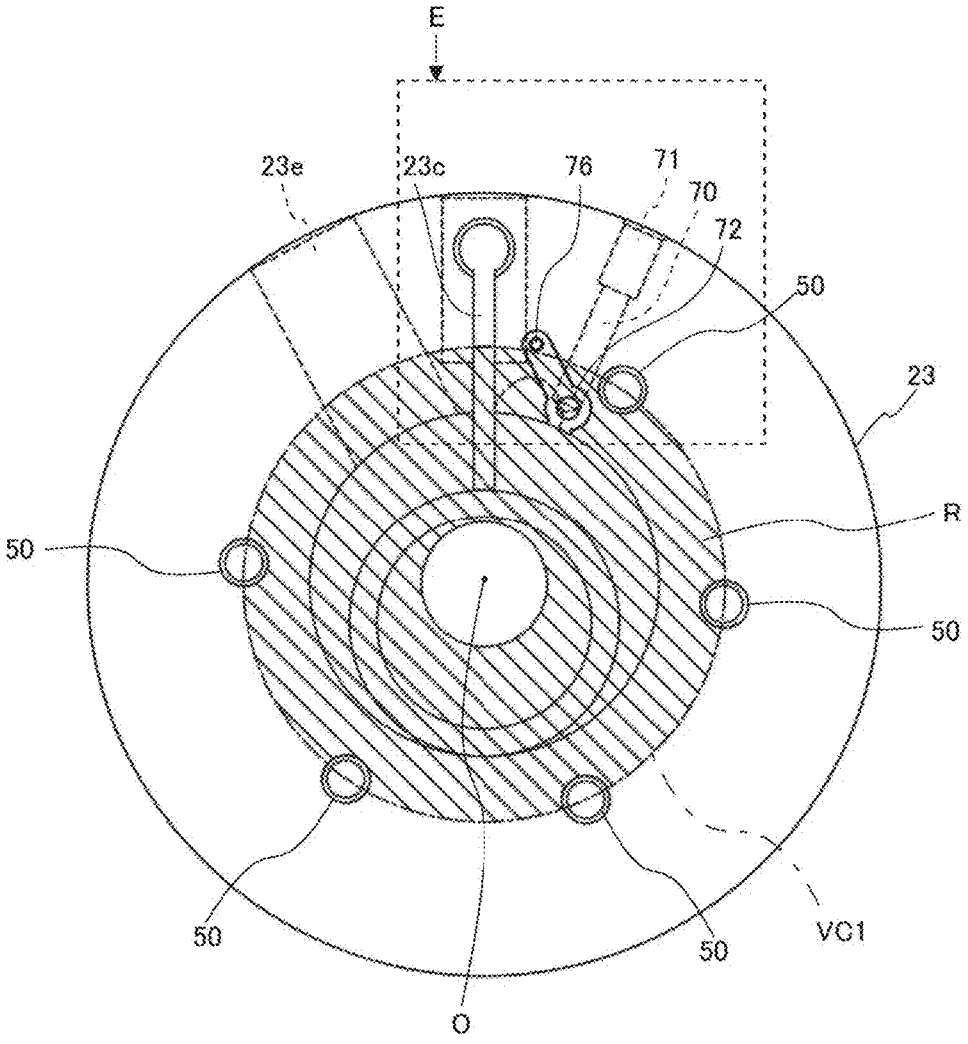
FIG. 7 is a schematic plan view that illustrates a region formed by connecting the centers of a plurality of bolt holes provided in the cylinder of the hermetic compressor according to the embodiment.
Figure 8:
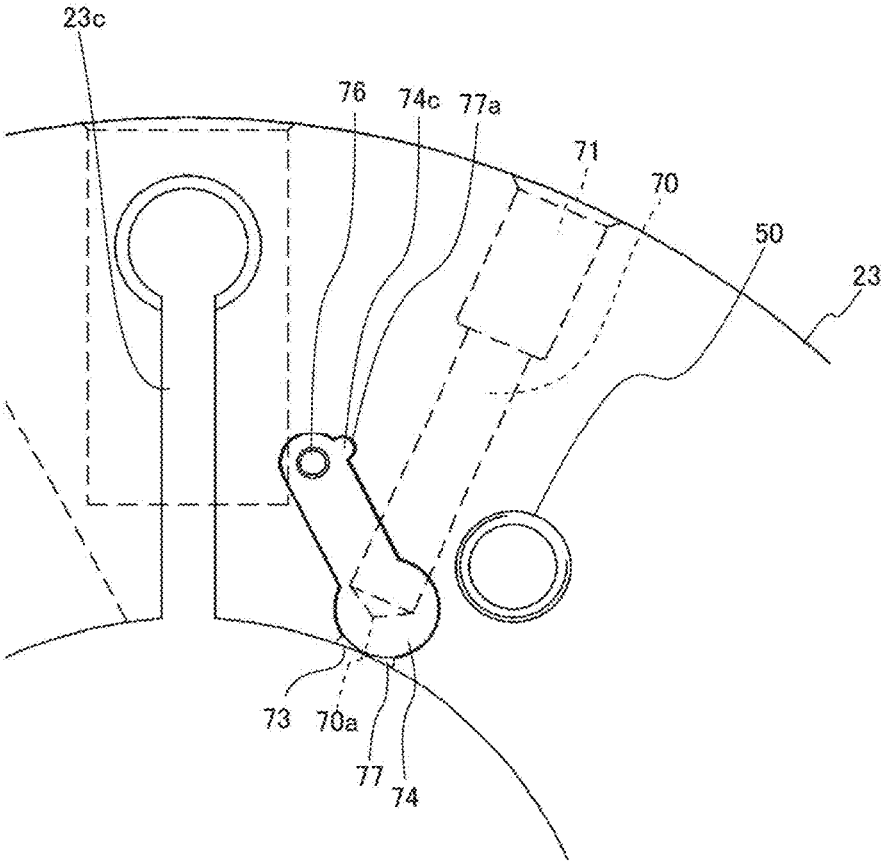
FIG. 8 is an enlarged schematic diagram that illustrates a portion of the compression mechanism section illustrated in FIG. 7 indicated by arrow E.

FIG. 7 is a schematic plan view that illustrates a region R formed by connecting the centers of a plurality of bolt holes 50 provided in the cylinder 23 of the hermetic compressor 100 according to the embodiment. FIG. 8 is an enlarged schematic diagram that illustrates a portion of the compression mechanism section 20 illustrated in FIG. 7 indicated by arrow E.

As illustrated in FIG. 7, in an end surface of the cylinder 23 in the height direction, the plurality of bolt holes 50 (hereinafter, also referred to as first fixation holes) are provided. To the bolt holes 50, unillustrated fastening bolts (hereinafter, also referred to as first fixation components) are inserted. Furthermore, by fixing the upper bearing 24, the intermediate plate 28, and the lower bearing 25 to the end surface of the cylinder 23 in the height direction by fastening bolts, the compression chamber 23*a* is formed in the cylinder 23. Note that, in the embodiment, as illustrated in FIG. 7, five bolt holes 50 are provided in the cylinder 23; however, the number is not limited to five. Four or fewer or six or more bolt holes 50 may also be provided. Also, the plurality of bolt holes 50 are provided in both end surfaces of the cylinder 23 in the height direction.

As illustrated in FIG. 8, the injection check valve 74 is fixed to an end surface of the cylinder 23 in the height direction by the fixation component 76. As illustrated in FIG. 7, the injection vertical hole 72 is located at a position 70 mm away from a center O of the cylinder 23. Also, the inner periphery of the cylinder 23 is located at a position 60 mm away from the center O of the cylinder 23. Also, the centers of the bolt holes 50 are located at positions 75 mm away from the center O of the cylinder 23. The bolt holes 50 are holes through which fastening bolts are inserted that fix components that form the compression chamber 23*a*, such as the cylinder 23, the upper bearing 24, the lower bearing 25, and the intermediate plate 28.

At the end surface of the cylinder 23 in which one end of the injection vertical hole 72 is formed, the injection vertical hole 72 is located in a region (the region R indicated by diagonal lines illustrated in FIG. 7) inside an imaginary circle VC1 formed by connecting the centers of the bolt holes 50, that is, an imaginary circle VC1 that has a circle center defined by the center O of the cylinder 23 and has radii from the center O of the cylinder 23 to the centers of the bolt holes 50.

Figure 10:
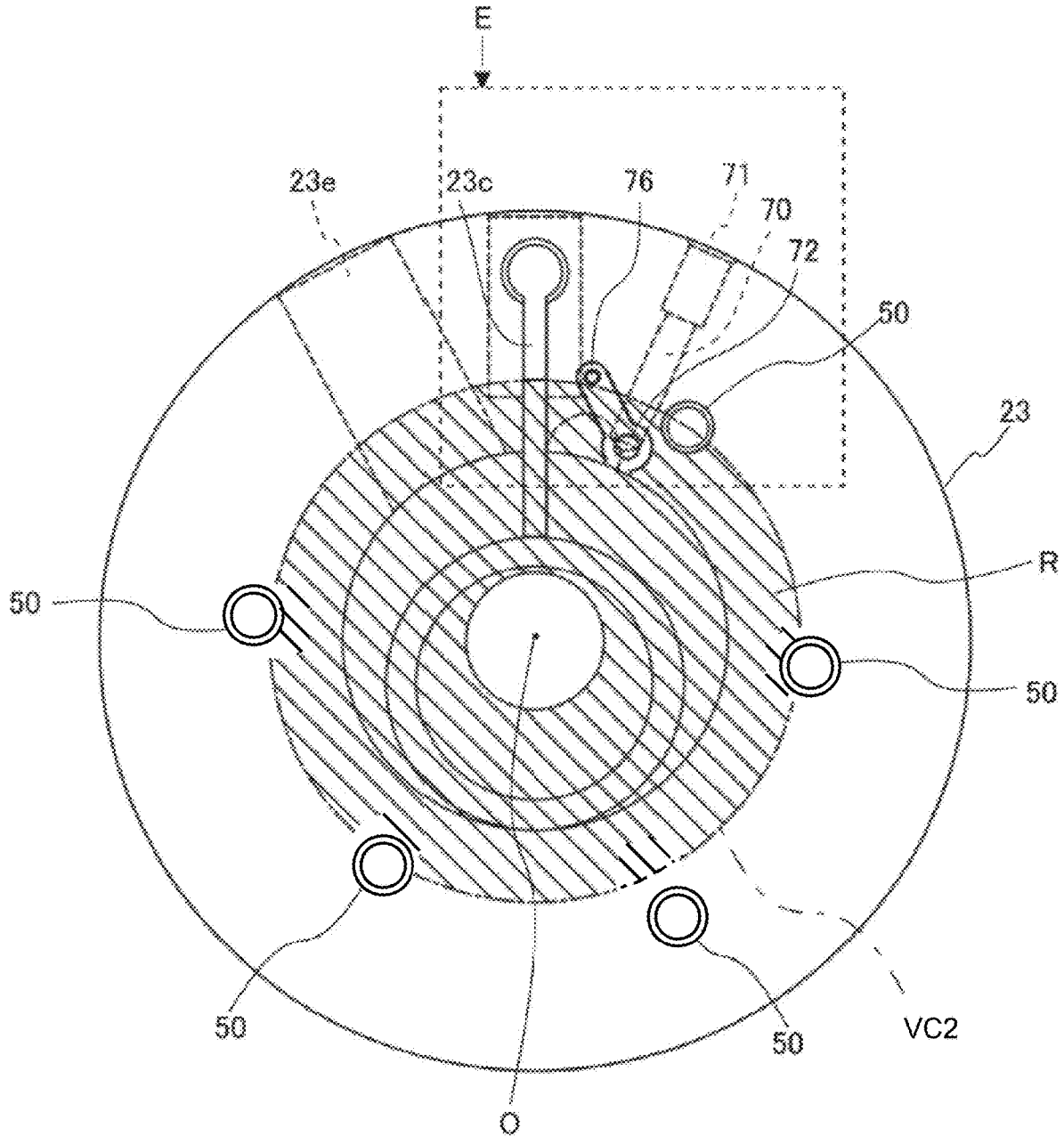
FIG. 10 is a schematic plan view that illustrates a region formed by connecting the centers of a plurality of bolt holes provided in the cylinder of the hermetic compressor according to an embodiment.

In the embodiment, as illustrated in FIG. 7, all the five bolt holes 50 provided in the cylinder 23 are located at the same distance from the center O of the cylinder 23. That is, the distances from the centers of the respective bolt holes 50 to the center O of the cylinder 23 are the same. However, a case illustrated for example in FIG. 10 is also considered where not all the bolt holes 50 are located at the same distance from the center O of the cylinder 23. In this case, at the end surface of the cylinder 23 in which one end of the injection vertical hole 72 is formed, the injection vertical hole 72 is located in a region inside an imaginary circle VC2 that has a circle center defined by the center O of the cylinder 23 and has the radius defined by the distance between the center of the bolt hole 50 (hereinafter, also referred to as the shortest first fixation hole) that is closest to the center O of the cylinder 23 and the center O of the cylinder 23.

Injection refrigerant is refrigerant that has higher pressure than suction refrigerant and is injected into the compression chamber 23*a* at a high rate. The hydrodynamic force of the injection refrigerant thereby may locally separate the seal between the cylinder 23 and the upper bearing 24, the lower bearing 25, or the intermediate plate 28. As a result, a gap is thus opened, through which refrigerant is likely to leak out of the compression mechanism section 20. Here, the form of these seals is such that a clearance between the metal plane surface of the cylinder 23, which is sufficiently polished, and the upper bearing 24, the lower bearing 25, or the intermediate plate 28, that is, a clearance between the metal plane surfaces, is filled with refrigerating machine oil.

As described above, the injection vertical hole 72 is located either in a region inside the imaginary circle VC1, which connects the centers of the bolt holes 50 through which fastening bolts are inserted that bring the metal plane surfaces into close contact with each other to form the seal between the cylinder 23 and the upper bearing 24, the lower bearing 25, or the intermediate plate 28 or in a region inside the imaginary circle VC2, which has the radius defined by the distance between the center of the bolt hole 50 that is closest to the center O of the cylinder 23 and the center O of the cylinder 23. The injection vertical hole 72, through which injection refrigerant flows, is thereby positioned in a region where the seal located further inside than a fixation portion where the cylinder 23 and the upper bearing 24, the lower bearing 25, or the intermediate plate 28 are fixed is less likely to be separated. As a result, injection refrigerant is prevented from leaking to the outside of the compression mechanism section 20 and deterioration in compression efficiency is also prevented. Note that, in the embodiment, as illustrated in FIG. 7, the entirety of the injection vertical hole 72 is located in the region inside the imaginary circle VC1 or the imaginary circle VC2. However, as long as at least a portion of the injection vertical hole 72 is located in the region inside the imaginary circle VC1 or the imaginary circle VC2, the effects described above are still obtained.

Also, as illustrated in FIG. 7, at the end surface of the cylinder 23 in which one end of the injection vertical hole 72 is formed, the fixation component 76, which fixes the injection check valve 74, is provided. This fixation component 76 is located at a position 85 mm away from the center O of the cylinder 23 and located in a region outside the imaginary circle VC1 or the imaginary circle VC2. By locating the fixation component 76 as described above, components such as those of the injection mechanism are more flexibly laid out and design constraints are reduced. As a result, wasted space in the hermetic container 10 is reduced, the overall size is reduced, and manufacturing costs are reduced.

Here, as illustrated in FIG. 4, a space between the injection vertical hole 72 and the fixation component 76 is occupied by the injection check valve lift amount control plate 75. For this reason, even when refrigerant leaks from the vicinity of the fixation component 76, the performance of the compressor is only slightly affected.

As illustrated in FIG. 8, to the injection check valve 74, a projection portion 74*c* is provided, which projects from the side surface of the injection check valve 74. Also, to the cylinder 23, a recess portion 77*a* is provided, which fits the projection portion 74*c* and limits the rotational action of the projection portion 74*c*. The projection portion 74*c* thus fits into the recess portion 77*a* and, when the injection check valve 74 moves in the rotational direction, the projection portion 74*c* thereby comes into contact with the recess portion 77*a*. For this reason, the recess portion 77*a* limits the rotational amount of the injection check valve 74 in the rotational direction when the bolt is fastened.

Note that a rotation stop mechanism of the injection check valve 74 is formed by the projection portion 74*c* and the recess portion 77*a*; however, the rotation stop mechanism is not limited to the one described above. As long as a structure is provided in which an acting portion of the injection check valve 74 that lifts interferes with only the injection check valve lift amount control plate 75 and does not interfere with components that form the compression mechanism section 20 and a non-acting portion of the injection check valve 74 that does not lift limits the rotational amount of the injection check valve 74, the rotation stop mechanism may also be one other than the one described above.

As illustrated in FIG. 7, when the discharge valve 24*a* and the injection check valve 74 are each projected onto the same end surface of the cylinder 23 in the height direction, these two opening-and-closing valves are located at positions where the valves interfere with each other. That is, when the discharge valve 24*a* and the injection check valve 74 are projected onto the same plane surface of the cylinder 23 in the height direction, these two opening-and-closing valves are located at positions where at least portions of the valves overlap with each other. By locating the two opening-and-closing valves on the same phase as described above, components such as those of the injection mechanism are more flexibly laid out and design constraints are reduced. As a result, wasted space in the hermetic container 10 is reduced, the overall size is reduced, and manufacturing costs are reduced.

Note that, in the embodiment, one discharge valve 24*a* and one injection check valve 74 are provided to one cylinder 23; however the numbers are not limited to these numbers. A plurality (two or more) of discharge valves 24*a* and a plurality (two or more) of injection check valves 74 may also be provided to one cylinder 23. In this case, when the plurality of discharge valves 24*a* and the plurality of injection check valves 74 are each projected onto the same plane surface of the cylinder 23 in the height direction, it is sufficient that at least a portion of the plurality of discharge valves 24*a* and at least a portion of the plurality of injection check valves 74 overlap with each other.

Figure 9:
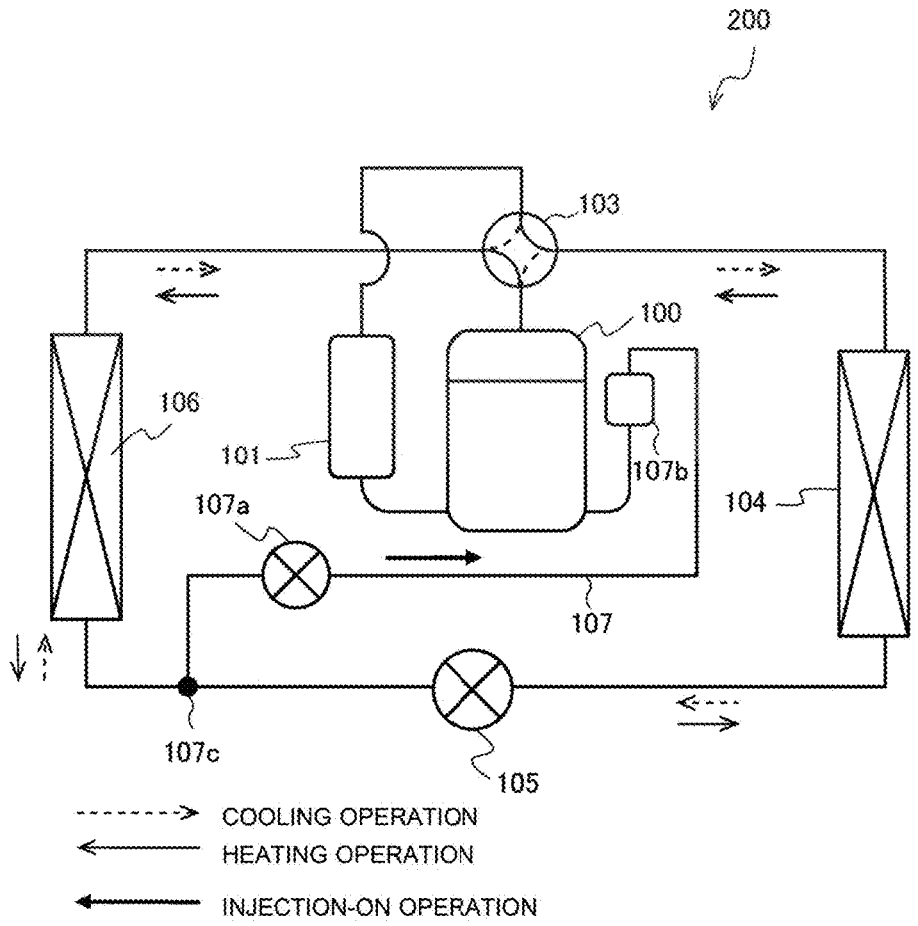
FIG. 9 is a schematic diagram that illustrates the configuration of a refrigeration cycle apparatus provided with the hermetic compressor according to the embodiment.

FIG. 9 is a schematic diagram that illustrates the configuration of a refrigeration cycle apparatus 200 provided with the hermetic compressor 100 according to the embodiment. Next, the refrigeration cycle apparatus 200 provided with the hermetic compressor 100 is described below with reference to FIG. 9. The refrigeration cycle apparatus 200 is, for example, an air-conditioning apparatus. The refrigeration cycle apparatus 200 is provided with the hermetic compressor 100 provided with the suction muffler 101 connected to the suction side of the hermetic compressor 100, a flow path switching valve 103 connected to the discharge side of the hermetic compressor 100, an outdoor heat exchanger 104, a pressure reducer 105, and an indoor heat exchanger 106. These components are serially connected by pipes and thereby forms a main circuit of the refrigerant circuit through which refrigerant circulates. Also, to the refrigerant circuit, the injection pipe 107 is provided, which branches from a branch point 107*c* of the main circuit between the pressure reducer 105 and the indoor heat exchanger 106 and is connected to the compression mechanism section 20 of the hermetic compressor 100. Also, at a point in the injection pipe 107, an injection pressure reducer 107*a* that adjusts injection pressure and a flow rate and an injection muffler 107*b* that rectifies the flow of refrigerant are provided. Note that the injection pressure reducer 107*a* may also serve as a device that switches on and off the injection or a solenoid valve may also be separately provided to the injection pipe 107 with the injection being switched on and off by the solenoid valve.

The flow path switching valve 103 is, for example, a four-way valve, and switches between a cooling operation and a heating operation by switching the flow directions of refrigerant. Note that, as the flow path switching valve 103, a combination of two-way valves and three-way valves, or other similar structures, may also be used instead of a four-way valve. The pressure reducer 105 reduces the pressure of refrigerant and thereby causes it to expand. The pressure reducer 105 is, for example, an electronic expansion valve that adjusts its expansion opening degree. The pressure reducer 105, by adjusting its opening degree, controls the pressure of refrigerant that flows into the indoor heat exchanger 106 during a cooling operation and controls the pressure of refrigerant that flows into the outdoor heat exchanger 104 during a heating operation. The outdoor heat exchanger 104 functions as an evaporator and a condenser, allows air and refrigerant to exchange heat with each other, and causes refrigerant to evaporate and gasify and causes refrigerant to condense and liquefy. The outdoor heat exchanger 104 functions as an evaporator during a heating operation and a condenser during a cooling operation. The indoor heat exchanger 106 functions as an evaporator and a condenser, allows air and refrigerant to exchange heat with each other, and causes refrigerant to evaporate and gasify and causes refrigerant to condense and liquefy. The indoor heat exchanger 106 functions as a condenser during a heating operation and an evaporator during a cooling operation.

In the case of a heating operation, the flow path switching valve 103 is connected to the solid line side illustrated in FIG. 9. High-temperature and high-pressure refrigerant compressed in the hermetic compressor 100 flows to the indoor heat exchanger 106, condenses, and liquefies. Subsequently, the refrigerant is reduced in pressure by the pressure reducer 105 into a low-temperature and low-pressure two-phase state, flows to the outdoor heat exchanger 104, evaporates, and gasifies. The refrigerant flows through the flow path switching valve 103 and returns to the hermetic compressor 100 again. That is, refrigerant circulates as indicated by the solid arrows illustrated in FIG. 9. By this circulation, refrigerant sent to the outdoor heat exchanger 104, which serves as an evaporator, exchanges heat with outdoor air and thereby receives heat at the outdoor heat exchanger 104 and the refrigerant that has received heat is sent to the indoor heat exchanger 106, which serves as a condenser, exchanges heat with indoor air, and thereby heats the indoor air.

Also, in a case where the heating capacity is further increased in a heating operation or in a case where operating conditions exist where suction pressure and discharge pressure largely differ and high temperatures are concentrated in certain areas of the compression mechanism section 20, opening the valve of the injection pressure reducer 107*a* allows relatively low-temperature refrigerant that has exchanged heat with indoor air at the indoor heat exchanger 106 to flow into the injection pipe 107 (see solid arrows illustrated in FIG. 9). The outlet of the injection pipe 107 is connected to the compression mechanism section 20 of the hermetic compressor 100 and relatively low-temperature refrigerant that flows into the injection pipe 107 thereby flows into the compression mechanism section 20 of the hermetic compressor 100 as injection refrigerant. Subsequently, the injection refrigerant that flows into the compression mechanism section 20 is compressed together with low-pressure refrigerant that flows from the main circuit into the suction muffler 101 and is discharged from the hermetic compressor 100 as high-temperature and high-pressure refrigerant gas.

In the case of a cooling operation, the flow path switching valve 103 is connected to the dashed line side illustrated in FIG. 9. High-temperature and high-pressure refrigerant compressed in the hermetic compressor 100 flows to the outdoor heat exchanger 104, condenses, and liquefies. Subsequently, the refrigerant is reduced in pressure by the pressure reducer 105 into a low-temperature and low-pressure two-phase state, flows to the indoor heat exchanger 106, evaporates, and gasifies. The refrigerant flows through the flow path switching valve 103 and returns to the hermetic compressor 100 again. That is, when a heating operation is switched to a cooling operation, the indoor heat exchanger 106 switches from a condenser to an evaporator and the outdoor heat exchanger 104 switches from an evaporator to a condenser. Thus, refrigerant circulates as indicated by the dashed arrows illustrated in FIG. 9. By this circulation, refrigerant exchanges heat with indoor air at the indoor heat exchanger 106, which serves as an evaporator, and receives heat from the indoor air, that is, cools the indoor air and the refrigerant that has received heat is sent to the outdoor heat exchanger 104, which serves as a condenser, exchanges heat with outdoor air, and thereby transfers heat to the outdoor air.

As described above, the hermetic compressor 100 according to the embodiment is provided with the cylinder 23 in which the compression chamber 23*a* in which refrigerant is compressed and the injection vertical hole 72 that forms a portion of the injection passage through which refrigerant is supplied into the compression chamber 23*a* and extends in the height direction are formed, closure components that are fixed to both respective end surfaces of the cylinder 23 in the height direction and close the compression chamber 23*a*, and the injection check valve 74 that opens and closes the injection vertical hole 72. The injection vertical hole 72 has one end formed at one end surface of the cylinder 23. In the one end surface of the cylinder 23, the plurality of first fixation holes are formed through which the plurality of first fixation components that fix a corresponding one of the closure components to the one end surface are inserted. The plurality of first fixation holes are located such that distances from the centers of the plurality of first fixation holes to the center O of the cylinder 23 are the same. The injection vertical hole 72 has at least a portion located in a region inside the imaginary circle VC1, which has a circle center defined by the center O of the cylinder 23 and has radil from the center O of the cylinder 23 to the centers of the plurality of first fixation holes.

Also, the hermetic compressor 100 according to the embodiment is provided with the cylinder 23 in which the compression chamber 23*a* in which refrigerant is compressed and the injection vertical hole 72 that forms a portion of the injection passage through which refrigerant is supplied into the compression chamber 23*a* and extends in the height direction are formed, closure components that are fixed to both respective end surfaces of the cylinder 23 in the height direction and close the compression chamber 23*a*, and the injection check valve 74 that opens and closes the injection vertical hole 72. The injection vertical hole 72 has one end formed at one end surface of the cylinder 23. In the one end surface of the cylinder 23, the plurality of first fixation holes are formed through which the plurality of first fixation components that fix a corresponding one of the closure components to the one end surface are inserted. In a case where, among the plurality of first fixation holes, one that has the shortest distance from the center of the one of the plurality of first fixation holes to the center O of the cylinder 23 is defined as the shortest first fixation hole, the injection vertical hole 72 has at least a portion located in a region inside the imaginary circle VC2, which has a circle center defined by the center O of the cylinder 23 and has a radius from the center O of the cylinder 23 to the center of the shortest first fixation hole.

The hermetic compressor 100 according to the embodiment is provided with the cylinder 23 in which the injection vertical hole 72 that forms a portion of the injection passage is formed. The injection vertical hole 72 has at least a portion located in a region inside the imaginary circle VC1, which has a circle center defined by the center O of the cylinder 23 and has radii from the center O of the cylinder 23 to the centers of the plurality of first fixation holes. Alternatively, the injection vertical hole 72 has at least a portion located in a region inside the imaginary circle VC2, which has a circle center defined by the center O of the cylinder 23 and has a radius from the center O of the cylinder 23 to the center of the shortest first fixation hole. By thus locating the injection vertical hole 72, leakage of injection refrigerant is prevented and deterioration in compression efficiency is also prevented.

Also, the hermetic compressor 100 according to the embodiment is provided with a second fixation component that fixes the injection check valve 74 to one end surface of the cylinder 23. The second fixation component is located in a region outside the imaginary circle VC1 or the imaginary circle VC2.

In the hermetic compressor 100 according to the embodiment, by locating the second fixation component in a region outside the imaginary circle VC1 or the imaginary circle VC2, components such as those of the injection mechanism are more flexibly laid out and design constraints are reduced. As a result, wasted space in the hermetic container 10 is reduced, the overall size is reduced, and manufacturing costs are reduced.

Also, in the hermetic compressor 100 according to the embodiment, the second fixation component is a bolt. A portion of the head portion 76*a* of the bolt projects beyond one end surface of the cylinder 23 into the closure component. In the closure component, the storage hole 76*b* is formed, in which the portion of the head portion 76*a* of the bolt is housed.

The hermetic compressor 100 according to the embodiment has the injection check valve operation groove 77, which has the limited distance in the depth direction, and thereby efficiently discharges compressed refrigerant.

Also, the hermetic compressor 100 according to the embodiment has the projection portion 74*c* provided on the side surface of the injection check valve 74 and the recess portion 77*a* provided in the cylinder 23. The recess portion 77*a* fits the projection portion 74*c* and limits the rotational action of the injection check valve 74.

In the hermetic compressor 100 according to the embodiment, the projection portion 74*c* fits into the recess portion 77*a* and, when the injection check valve 74 moves in the rotational direction, the projection portion 74*c* thereby comes into contact with the recess portion 77*a*. For this reason, the recess portion 77*a* limits the rotational amount of the injection check valve 74 in the rotational direction when the bolt is fastened.

The present application is not limited to the embodiment exactly described above and, at an implementation phase, may also be achieved with modified components without departing from the gist of the present application. Furthermore, a plurality of components disclosed in the embodiment described above may be appropriately combined.

REFERENCE SIGNS LIST

10: hermetic container, 10*a*: bottom portion, 11: upper container, 12: lower container, 20: compression mechanism section, 21: rotating shaft, 21*a*: main shaft portion, 21*b*: eccentric shaft portion, 21*c*: auxiliary shaft portion, 22: rolling piston, 23: cylinder, 23*a*: compression chamber, 23*b*: back-pressure chamber, 23*c*: vane groove, 23*d*: discharge notch, 23*e*: suction port, 24: upper bearing, 24*a*: discharge valve, 24*b*: discharge port, 25: lower bearing, 26: vane, 27: discharge muffler, 28: intermediate plate, 30: motor, 31: stator, 32: rotor, 50: bolt hole, 70: injection lateral hole, 70*a*: tip hole, 71: injection pipe connection portion, 72: injection vertical hole, 73: communication portion, 74: injection check valve, 74*c*: projection portion, 75: injection check valve lift amount control plate, 76: fixation component, 76*a*: head portion, 76*b*: storage hole, 77: injection check valve operation groove, 77*a*: recess portion, 100: hermetic compressor, 101: suction muffler, 102: discharge pipe, 103: flow path switching valve, 104: outdoor heat exchanger, 105: pressure reducer, 106: indoor heat exchanger, 107: injection pipe, 107*a*: injection pressure reducer, 107*b*: injection muffler, 107*c*: branch point, 110: suction connection pipe, 200: refrigeration cycle apparatus

The invention claimed is:

1. A hermetic compressor comprising:

a cylinder in which a compression chamber in which refrigerant is compressed and an injection vertical hole that forms a portion of an injection passage through which refrigerant is supplied into the compression chamber and extends in a height direction are formed;

closure components that are fixed to both respective end surfaces of the cylinder in a height direction and close the compression chamber, the both respective end surfaces include one end surface and an other end surface opposite to the one end surface; and an injection check valve that opens and closes the injection vertical hole, the injection vertical hole having one end formed at the one end surface of the cylinder, in the one end surface of the cylinder, a plurality of first fixation holes being formed through which a plurality of first fixation components that fix a corresponding one of the closure components to the one end surface are inserted, the plurality of first fixation holes being located such that distances from centers of the plurality of first fixation holes to a center of the cylinder are the same, the injection vertical hole having at least a portion located in a region inside an imaginary circle that has a circle center defined by the center of the cylinder and has radii from the center of the cylinder to the centers of the plurality of first fixation holes, the hermetic compressor further comprising a second fixation component that fixes the injection check valve to the one end surface of the cylinder, the second fixation component being located in a region outside the imaginary circle, wherein the second fixation component includes a head portion at least a portion of which projects beyonds the one end surface of the cylinder into the corresponding one of the closure components, and in the corresponding one of the closure component, a storage is formed in which at least the portion of the head portion is housed.

2. The hermetic compressor of claim 1, wherein the second fixation component is a bolt, and in the corresponding one of the closure components, the storage being a storage hole in which the portion of the head portion of the bolt is housed.

3. The hermetic compressor of claim 2, comprising:

a projection portion provided on a side surface of the injection check valve; and a recess portion provided in the cylinder, wherein the recess portion fits the projection portion and limits a rotational action of the injection check valve.

4. A refrigeration cycle apparatus comprising the hermetic compressor of claim 3.

5. A refrigeration cycle apparatus comprising the hermetic compressor of claim 2.

6. The hermetic compressor of claim 1, comprising:

a projection portion provided on a side surface of the injection check valve; and a recess portion provided in the cylinder, wherein the recess portion fits the projection portion and limits a rotational action of the injection check valve.

7. A refrigeration cycle apparatus comprising the hermetic compressor of claim 6.

8. A refrigeration cycle apparatus comprising the hermetic compressor of claim 1.

9. A hermetic compressor comprising:

a cylinder in which a compression chamber in which refrigerant is compressed and an injection vertical hole that forms a portion of an injection passage through which refrigerant is supplied into the compression chamber and extends in a height direction are formed;

closure components that are fixed to both respective end surfaces of the cylinder in a height direction and close the compression chamber, the both respective end surfaces include one end surface and an other end surface opposite to the one end surface; and an injection check valve that opens and closes the injection vertical hole, the injection vertical hole having one end formed at the one end surface of the cylinder, in the one end surface of the cylinder, a plurality of first fixation holes being formed through which a plurality of first fixation components that fix a corresponding one of the closure components to the one end surface are inserted, among the plurality of first fixation holes, one that has a shortest distance from a center of the one of the plurality of first fixation holes to a center of the cylinder is defined as a shortest first fixation hole, the injection vertical hole having at least a portion located in a region inside an imaginary circle that has a circle center defined by the center of the cylinder and has a radius from the center of the cylinder to a center of the shortest first fixation hole, the hermetic compressor further comprising a second fixation component that fixes the injection check valve to the one end surface of the cylinder, the second fixation component being located in a region outside the imaginary circle.

10. The hermetic compressor of claim 9, wherein the second fixation component is a bolt, a portion of a head portion of the bolt projects beyond the one end surface of the cylinder into the corresponding one of the closure components, and in the corresponding one of the closure components, a storage hole is formed in which the portion of the head portion of the bolt is housed.

11. The hermetic compressor of claim 10, comprising:

a projection portion provided on a side surface of the injection check valve; and a recess portion provided in the cylinder, wherein the recess portion fits the projection portion and limits a rotational action of the injection check valve.

12. A refrigeration cycle apparatus comprising the hermetic compressor of claim 11.

13. A refrigeration cycle apparatus comprising the hermetic compressor of claim 10.

14. The hermetic compressor of claim 9, comprising:

a projection portion provided on a side surface of the injection check valve; and a recess portion provided in the cylinder, wherein the recess portion fits the projection portion and limits a rotational action of the injection check valve.

15. A refrigeration cycle apparatus comprising the hermetic compressor of claim 14.

16. A refrigeration cycle apparatus comprising the hermetic compressor of claim 9.

* * * * *